US006543346B2

(12) United States Patent
Rodefeld

(10) Patent No.: US 6,543,346 B2
(45) Date of Patent: Apr. 8, 2003

(54) APPARATUS FOR PRINTING ON INDIVIDUAL ARTICLES

(75) Inventor: Dietrich Rodefeld, Hilter (DE)

(73) Assignee: Werner Kammann Maschinenfabrik GmbH (DE)

( * ) Notice: Subject to any disclaimer, the term of this patent is extended or adjusted under 35 U.S.C. 154(b) by 0 days.

(21) Appl. No.: 09/886,519

(22) Filed: Jun. 21, 2001

(65) Prior Publication Data

US 2002/0002914 A1 Jan. 10, 2002

(30) Foreign Application Priority Data

Jul. 5, 2000 (DE) ..... 100 32 525

(51) Int. Cl.[7] ..... B41F 17/00

(52) U.S. Cl. ..... 101/35; 101/4; 101/44; 101/476

(58) Field of Search ..... 101/35–44, 4, 101/126, 211, 238, 240, 476

(56) References Cited

U.S. PATENT DOCUMENTS 3,834,522 A * 9/1974 Jackson ..... 101/40.1
4,969,790 A * 11/1990 Petz et al. ..... 118/500
5,165,340 A * 11/1992 Karlyn et al. ..... 101/115
5,520,107 A 5/1996 Airoldi
6,082,256 A 7/2000 Hellmeier et al.

FOREIGN PATENT DOCUMENTS

EP 0 909 728 A1 4/1999

* cited by examiner

*Primary Examiner*—Andrew H. Hirshfeld
*Assistant Examiner*—Minh H. Chau
(74) *Attorney, Agent, or Firm*—Howson and Howson

(57) ABSTRACT

An apparatus for printing on dimensionally stable individual articles has a conveyor for conveying the articles, along which printing stations and other treatment stations are arranged. CDs are fed in a magazine in the form of a stack to a separating station, individually separated, and then each fitted into a respective receiver of the conveyor. The printed articles are removed in a removal station from the respective receivers and fed to a magazine in a collecting station. A conveyor belt conveys the magazines both through the separating stations and also through the collecting station, the conveyor belt conveying the empty magazines from the separating station into the collecting station. At least one stepwise circulating transfer arrangement forms a second conveyor path along which are arranged the separating station, the respective receivers disposed in the receiving station for the printed article, and the collecting station.

15 Claims, 4 Drawing Sheets

APPARATUS FOR PRINTING ON INDIVIDUAL ARTICLES

FIELD OF THE INVENTION

The invention concerns an apparatus for printing on individual articles, more particularly dimensionally stable articles such as CDs.

BACKGROUND OF THE INVENTION

A printing machine which is frequently used for decorating CDs is to be found for example in EP 0 909 728 A1, having a conveyor belt which serves both for the conveyor feed of the articles to be printed upon, and also for conveying away the printed articles. Those articles are supplied in the form of a stack as a magazine. The magazine essentially comprises a bottom member or base from which a post extends upwardly, so that the articles which are each provided with a central opening are fitted on to the post. For the purposes of introducing the articles into the receiving means of the actual printing machine, they are removed from the stack and separated into individual articles and, after complete printing has been effected thereon, collected in a magazine again, in the form of a stack. In general terms, the procedure in that case is such that the empty magazines from which the articles to be printed upon had been individually removed are then used again for collecting a stack of printed articles.

SUMMARY OF THE INVENTION

An object of the invention is to provide an apparatus for printing on individual articles such as CDs, which is so designed as to simplify handling of the articles and magazines for same in connection with the operations of separating the articles to be printed upon and introducing them into receiving means of a conveyor arrangement of the printing apparatus and removing printed articles from the conveyor arrangement and collecting those articles in a magazine.

Another object of the present invention is to provide an article-printing apparatus which is of such a configuration that an operator can more easily and safely gain access to functional parts of the apparatus.

Still another object of the present invention is to provide an apparatus for printing on individual CDs in a continuous operating procedure while being of such a design layout that the apparatus can be readily monitored and supervised by an operator.

In accordance with the principles of the present invention an apparatus for printing on dimensionally stable individual articles such as CDs is provided with a conveyor arrangement for transportation of the articles along a first conveyor path. Provided along the conveyor path are at least one printing station, at least one entry station for the articles to be printed upon and a removal station for the printed articles. The articles to be printed upon are transported in a magazine as a stack including a plurality of articles into a separating station and are individually separated therein. The articles are each fitted into a receiving means of the conveyor arrangement and after the printing operation the printed articles are removed in the removal station from the respective receiving means of the conveyor arrangement and assembled in a magazine disposed in a collecting station to form a stack including a plurality of articles, for discharge thereof. A conveyor means conveys the magazines containing the articles to be printed upon in a direction towards the entry station and then conveys the empty magazines in a direction towards the removal station. The apparatus further has at least one transfer arrangement by means of which the articles to be printed upon are individually removed from their magazine and moved in a direction towards the respective receiving means of the conveyor arrangement or the printed articles removed from the respective receiving means of the conveyor arrangement are fed to the magazine for discharge thereof. The conveyor means includes a conveyor belt for conveying the magazines both through the separating station and also through the collecting station. The conveyor belt conveys the empty magazines out of the separating station into the collection station. The transfer arrangement comprises at least one stepwise circulating transfer arrangement for the individual articles, providing a second conveyor path at which are arranged the magazine respectively disposed in the separating station, the receiving means respectively disposed in the receiving station for the article to be printed upon, the respective receiving means respectively disposed in the removal station for the printed article, and the magazine disposed in the collecting station.

Thus the conveyor belt for the magazines transports the magazines both through the separating station for individually separating the articles to be printed upon and also through the collecting station for the printed articles. The articles are individually removed from the magazine in the separating station in the usual manner by the transfer arrangement and moved to the respective receiving means of the conveyor arrangement of the printing machine, and the printed articles are taken from the respective receiving means of the conveyor arrangement and transported to the magazine which is disposed in the collecting station, while the conveyor belt transports the emptied magazines from the separating station into the collecting station for subsequent charging of the magazines with printed articles.

Preferably, the conveyor belt is appropriately in the form of a curved belt and forms an endless conveyor path, thus providing, upstream of the respective magazine in the separating station, an accumulation or buffer space for at least one further magazine filled with articles to be printed upon, in order in that way to form a stock of magazines and, after emptying of the magazine in the separating station, to be able to perform rapid substitution of a filled magazine for an empty magazine. An accumulation space for at least one empty magazine can also be provided upstream of the respective magazine in the collecting station, as considered in the conveyor direction of the conveyor belt. That means that the portion of the second conveyor path which is formed by the conveyor belt and which is between the separating stations and the collecting stations must be of a corresponding length in order to form an accumulation space for the required number of magazines.

An advantage of the invention is that, by virtue of a corresponding prolongation of the conveyor belt, it is possible for the stations at which the magazines filled with the articles to be printed upon are put on to the conveyor belt or the magazines filled with the printed articles are carried away from the conveyor belt to be arranged in such a way that they are easily accessible from the exterior and if possible are disposed in a region in which an operator cannot be in danger due to any rotating parts of the machine or the like. It is also readily possible for those two stations to be arranged at such a small spacing from each other that they can be conveniently monitored and operated by only one operator. It is furthermore also possible for the configuration of the conveyor belt to be so selected that, outside the apparatus or at an edge region of the apparatus it passes through a station in which the magazines provided with printed articles are emptied and thereupon the emptied magazines are filled with articles to be printed upon and the filled magazines are conveyed in a direction towards the separating station.

A simplification which can be achieved by using the invention and the adaptability to the respective circumstances involved, in particular in terms of handling of the magazines, become clear in particular when, in accordance with a further preferred feature of the invention, the apparatus is so designed that a first group of the articles transported by the common conveyor arrangement is printed upon in at least a first printing station and a second group of articles is printed upon in at least a second printing station. Provided for each group of articles is a respective particular entry station for the articles to be printed upon, a removal station for the printed articles, a conveyor belt and a transfer arrangement. With that arrangement therefore there is a complete system for each group of articles so that both groups can be separately introduced into the apparatus and separately removed therefrom again. That is advantageous in particular if the two groups of articles are to be provided with different print images, as is often the usual situation with machines of that kind. There is then no risk that the articles with different printing thereon become mixed up with each other. In addition, the fact that the groups of articles are handled separately means that there is also the possibility of optionally using only one handling arrangement and thus printing upon only one group of articles.

Further objects, features and advantages of the invention will be apparent from the description hereinafter of a preferred embodiment of the invention.

DESCRIPTION OF THE PREFERRED EMBODIMENT

Figure 1:
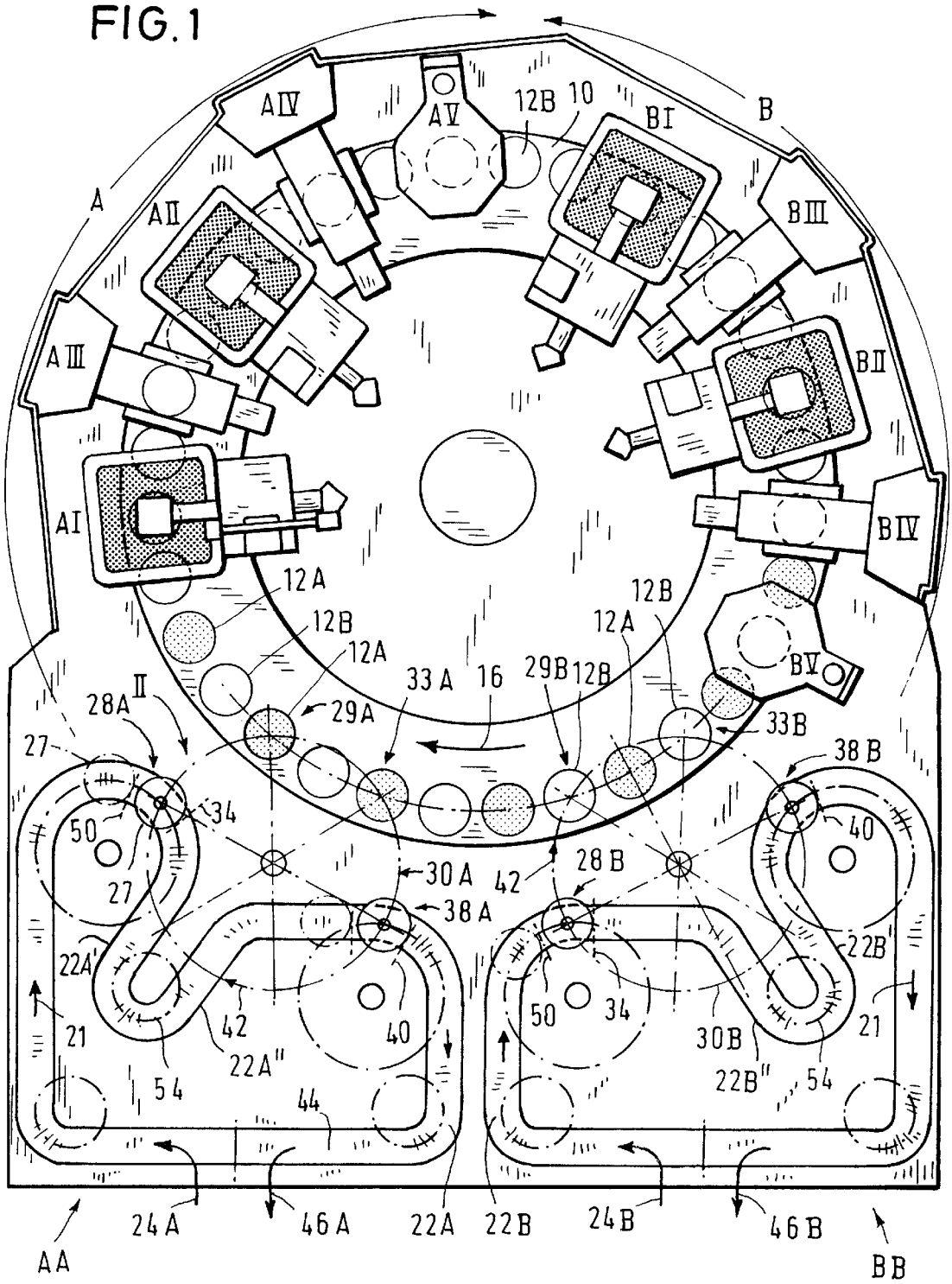
FIG. 1 is a diagrammatic plan view of an apparatus shown in the form of a printing machine with two separate arrangements for handling magazines and for separating the articles into individual articles.

Referring firstly generally to FIG. 1 the illustrated embodiment of the invention comprises a printing machine having a conveyor arrangement for the articles, in the form of an annular disk 10 which is driven in rotation with a stepwise movement by a suitable drive and which, in the proximity of its outer periphery, is provided with holders or receiving means 12A, 12B such as recesses for the articles 14 which are CDs. A plurality of stations for treating the articles are arranged along the first conveyor path for the articles, which is defined by the annular disk 10 which rotates with a stepwise movement in the direction indicated by the arrow 16. The stations for treating the articles are inter alia for example screen printing stations and drying stations. The annular disk 10 is provided with an even number of receiving means 12A, 12B. The embodiment illustrated in the drawing has thirty two receiving means. The receiving means are arranged at equal spacings from each other and in the usual manner are of such a design configuration that they can be connected to a reduced-pressure source so that the respective article disposed in a receiving means is held by a reduced pressure in its respective position within the receiving means.

The treatment stations for treatment of the articles are at least predominantly subdivided into two groups and arranged in two treatment regions indicated at A and B, of which the treatment region A has two screen printing stations AI and AII and two drying stations AIII and AIV. The treatment region B includes inter alia the treatment stations BI and BII and two drying stations BIII and BIV.

The embodiment illustrated in the drawing is further provided with two arrangements AA and BB for handling magazines carrying the articles 14 and for individually separating the CDs to be printed upon and for collecting the printed CDs in a magazine.

The CDs are also subdivided into two groups, of which the first group is fed to the handling arrangement AA and the second group is fed to the handling arrangement BB. The articles which are fed to the handling arrangement AA are treated in the treatment stations of the treatment region A while the articles which are fed to the handling arrangement BB are treated in the stations of the treatment region B.

The printed articles of the two groups are fed back to the respective one of the two handling arrangements AA and BB, to which they had been fed in the non-printed condition. As the two groups of CDs or other articles are normally printed upon in different ways, in this manner the two groups of different articles can also be discharged separately from the apparatus and are thus kept apart from each other without any difficulties.

As the two handling arrangements AA and BB are the same in terms of their basic structure, only the arrangement AA will be described hereinafter.

Figure 3:
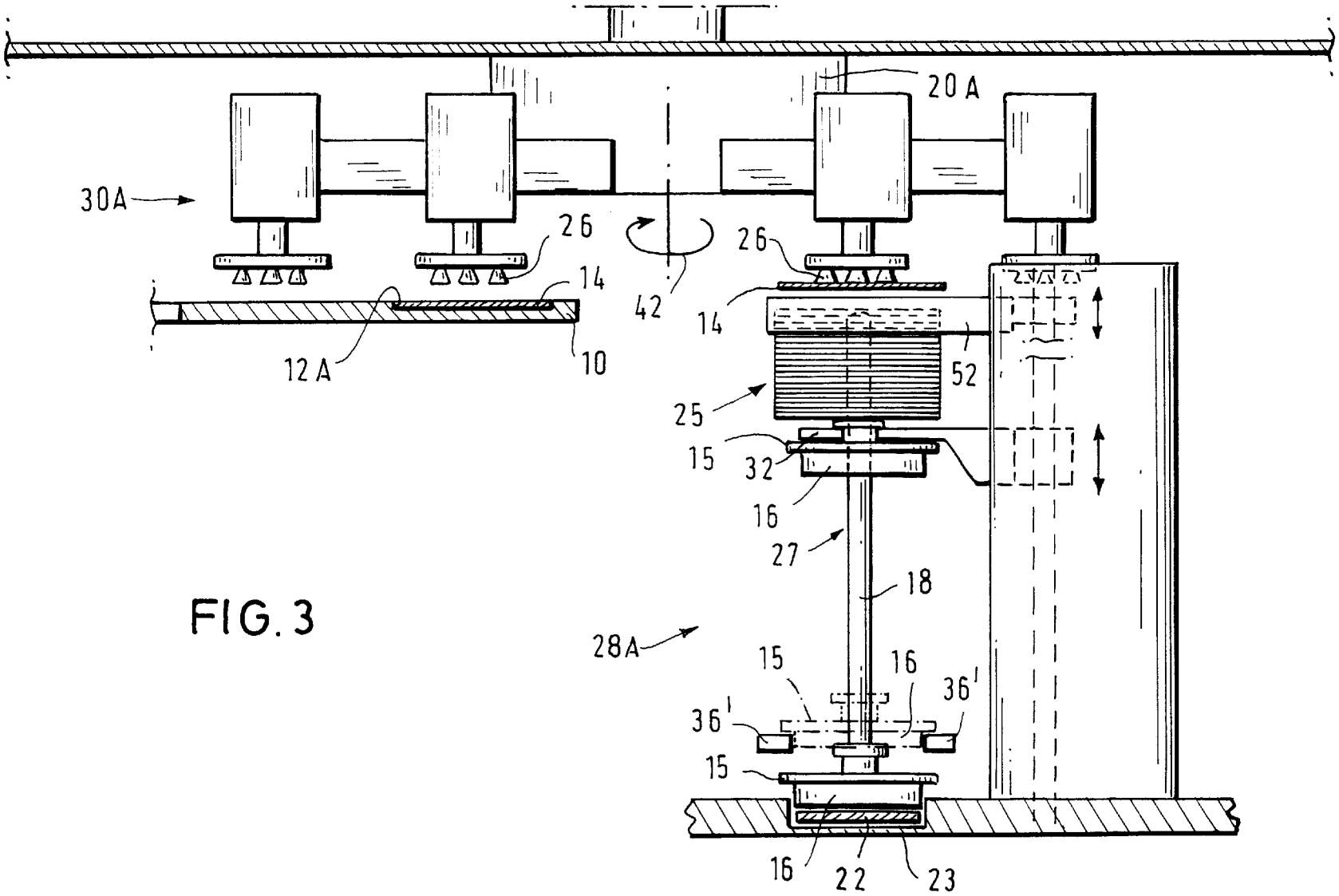
FIG. 3 is a view approximately in the direction of the arrows III—III in FIG. 2.

It is provided with an endless second conveyor arrangement in the form of a conveyor belt 22A which slides on a base or floor indicated at 23 in FIG. 3 and circulates in a horizontal plane, that is to say parallel to the plane in which the annular disk 10 is also advanced in a stepwise movement. The conveyor belt 22A which advantageously runs continuously is in the form of a curved belt which for example comprises a plurality of rigid plates which are smooth at the top side and which comprise plastic material or another material having a low coefficient of friction. Those plates are connected together in such a way as to be pivotable relative to each other and in somewhat overlapping relationship with each other in a horizontal plane. The curved belt, for the configuration of which attention is directed in particular to FIG. 1, forms a conveyor path for the magazines 27 carrying the CDs. In the usual manner, as can be seen from FIG. 3, the magazines 27 essentially comprise a base 16 which at its top side has a rim 15 and which carries a centrally arranged post 18 for extending through the central openings of the CDs held in the magazine.

The magazines 27 filled with CDs of the first group, to which printing is to be applied, are put in the feed station 24A of the handling arrangement AA on to the conveyor belt 22A which moves in the direction indicated by the arrow 21 in FIG. 1. From the feed station 24A the magazines 27 on the conveyor belt 22A pass through two curved regions into a separating station 28A in which the magazine assumes a position in opposite relationship to the entry station 29A. Disposed in the entry station 29A in the period of time between two conveyor steps on the part of the annular disk 10 is an empty receiving means 12A which will be provided with an article to be printed upon, in a manner to be described hereinafter.

Figure 2:
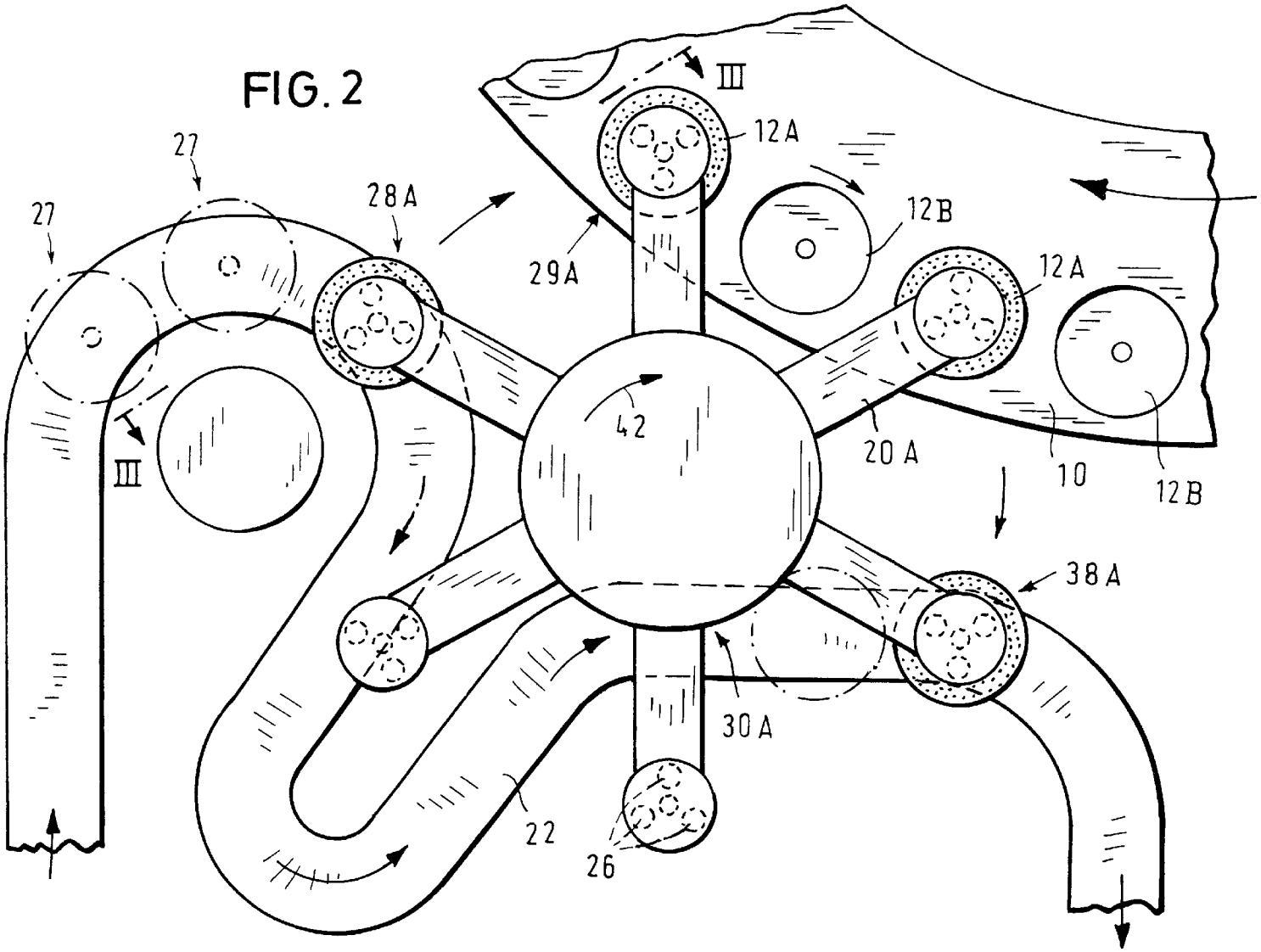
FIG. 2 is a plan view of a transfer arrangement of the FIG. 1 machine.

The spacing between the separating station 28A and the entry station 29A is bridged across by a transfer arrangement 30A which is shown diagrammatically in FIG. 1 and in more detail in FIGS. 2 and 3 and which is provided with a transfer element 20A which circulates in a stepwise manner about a vertical axis and at the underside of which are disposed distributed at uniform spacings over its periphery six vacuum holders 26 which are designed in the usual manner and which each have three short tube portions which can be connected to a vacuum source. The transfer element is arranged in such a fashion that it can be appropriately raised and lowered in known manner.

The magazine 27 in the separating station 28A is firstly prevented from following the movement of the conveyor belt 22A passing therebeneath by a first barrier 34 which can be selectively lifted. That barrier 34 can be in the form of a simple abutment which is reciprocatable between a position in which it projects into the path of conveyor movement for the magazine 27 and holds the magazine fast in the separating station 28A, and an inoperative position in which the barrier is lifted. As the conveyor belt 22A moves continuously, it is provided with a low-friction surface so that a high level of friction does not have to be overcome between the magazines 27 which are disposed on the conveyor belt 22A when the magazines are retained by a barrier 34 and are thus not entrained by the conveyor belt, and the conveyor belt itself.

The abutment 34 also serves for orienting the magazine 27 in relation to a first gripper 36 which, after it has been closed, grips the base 16 of the magazine, aligns same with respect to the transfer arrangement and lifts it so that, during the major part of its residence time in the separating station 28*a*, it is out of contact with the continuously moving conveyor belt 22A. The two parts as indicated at 36' in FIG. 3 of the gripper 36 which aligns the magazine with respect to the transfer element are each arranged laterally in the conveyor belt 22A so that they embrace the conveyor belt and the conveyor belt passes through between the two parts 36' of the gripper. The vertical movements of the gripper 36 are produced by a stepping motor which makes it possible for the magazine to be moved to a given height which for example depends on the length of the post 18 of the respective magazine and thus the height of the stack contained therein. Using a stepping motor means that it is possible for the distance by which the magazine is lifted by the gripper 36 to be adapted at any time to the respective circumstances involved, that is to say in particular different post lengths and thus different heights of stack in the magazine. The gripper 36 of the separating station 28A is shown in the raised condition in FIG. 4.

Referring now to FIG. 3, the separating station 28A is provided with known support means 32 which can be moved up and down and which engage under the stack 25 of CDs in the magazine 27 held by the gripper 36, and which lift the stack stepwise in such a way that the respective uppermost CD in the stack is at a given suitable height at which it is engaged by a respective vacuum holder 26 of the transfer element 26A, which is above the stack, when the transfer element is lowered. The support means 32 are not shown in FIG. 4 for the sake of clarity of the drawing.

In the course of the following upward movement of the transfer element 20A the respectively uppermost CD is lifted off the stack 25 as shown in FIG. 3 and, in the course of a following rotary movement of the transfer element 20A through 60°, moved into a position above the respective receiving means or holder 12A which is in the entry station 29A. After that, the transfer element 20 is lowered again so that the CD held by the vacuum holder 26 passes into the receiving means 12A which is disposed therebeneath. After the reduced pressure at that vacuum holder 26 is switched off, the transfer element can be raised, in which case the CD remains in the holder 12A (see FIG. 3). In the raised condition, the transfer element 20A is advanced by a conveyor step, that is to say through 60°. At the same time, the rotating annular disk 10 of the printing machine can also be advanced in the direction of the arrow 16 by one conveyor step which corresponds to double the spacing between two immediately adjacent holders 12A and 12B so that now the following empty holder 12A passes into the entry station 29A.

Figure 4:
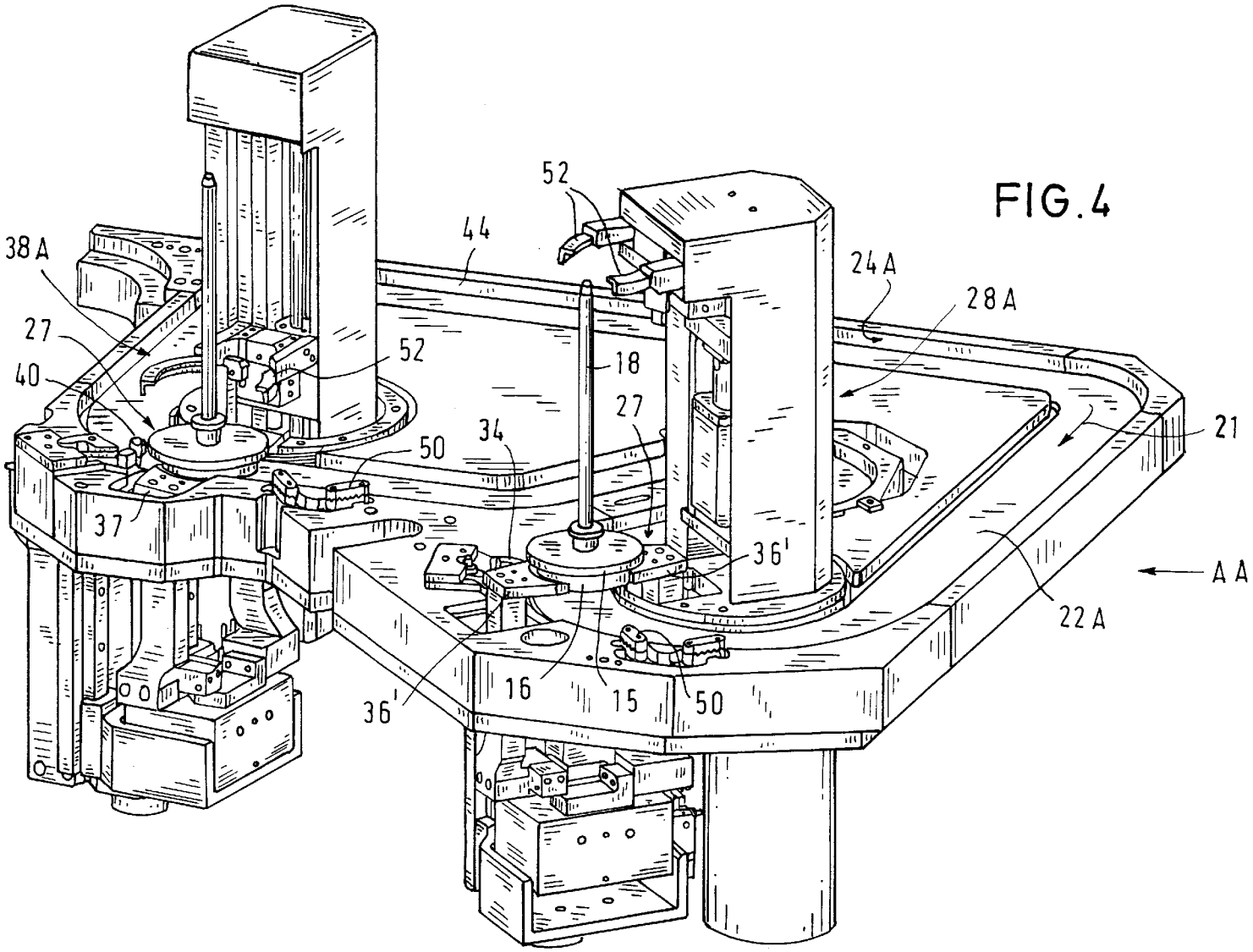
FIG. 4 is a perspective view of an arrangement for handling magazines and articles, with parts of that arrangement being omitted.

After the magazine 27 in the separating station 28A has been emptied by the transfer of all CDs into holders 12A of the annular disk 10, it is lowered again on to the conveyor belt 22A by the gripper 36 and released by moving the gripper parts 36' away from each other so that, after the first barrier 34 is lifted from the continuously moving conveyor belt 22A, the magazine 27 is entrained in a condition of standing on the moving conveyor belt and passes by way of two further curved regions into the collecting station 38A which is provided with a second barrier 40 and a gripper 37, similarly to the first barrier 34 and the gripper 36 of the separating station 28A. The empty magazine is lifted off the conveyor belt 22A by the gripper 37 which is identical to the gripper 36 in respect of function, design configuration, arrangement and drive, and held at a height which is respectively suitable for receiving the printed CDs. FIG. 4 shows the magazine 27 illustrated in the collecting station 38A, in its lower position in which it stands on the belt 22A. Consequently, the gripper 36 which is not closed is also in its lower position.

The magazine which is disposed in the collecting station 38A is oriented relative to the station 31A in which the printed CDs are removed from the respective holders 12A which are disposed there and relative to the transfer element 20A, in such a way that each vacuum holder 26 of the circulating transfer element of the transfer arrangement 30A, which prior to the last conveyor step thereof deposited an CD to be printed in the receiving station 29A in a holder 12A, comes into contact in the course of a renewed downward movement of that transfer element 20A with the CD which lies in the respective holder 12A in the removal station 33A, and lifts that CD out of the holder when the reduced pressure is switched on, in the course of the subsequent upward movement of the transfer element. In the following stepping conveyor movement of the transfer element 20A in the direction of the arrow 42 the printed CD is transported over the magazine 27 which is in the collecting station 38A and, after the transfer element has been moved downwardly again, the printed CD is discharged to the magazine 27 by the vacuum being switched off.

The two grippers 36 and 37 are not shown in FIG. 1 for reasons of clarity of the drawing.

After the CD has been delivered to the respective magazine in the collecting station 38A, the transfer element 20A is lifted again, whereupon the vacuum holder 26 which is in the collecting station 38A at that time, in the course of three following switching steps in the direction of the arrow 42, passes again into the removal position 28A so that, in the manner already described above, a CD is picked up out of the respective magazine disposed there and, in the course of the next conveyor step, transported over a receiving means 12A which is then in the entry station 29A, and then deposited therein.

After the magazine filled with printed articles in the collecting station 38A has been lowered again on to the conveyor belt 22A by the gripper 37 and the second barrier 40 has been rendered inoperative, the magazine is transported in the conveyor direction 21 through two further curve regions of the belt 22A into the linear portion 44 thereof which is remote from the annular disk 10, so that the magazine is then removed from the linear portion 44 at a discharge station 46A. The latter is disposed in the proximity of the feed station 24A so that, with manual handling of the magazines, an operator can monitor and operate both the feed station 24A and also the removal station 46A. It will be noted however that it is also possible for the feed of the magazines filled with articles to be printed upon in the entry station 24A and also removal of the magazines filled with printed articles in the discharge station 46A to be automated.

So that, during the magazine change procedure in the stations 28A, 28B and 30A, 30B respectively, articles to be printed upon can still be transferred into the receiving means 12A, 12B and printed articles can be removed from the receiving means 12A, 12B, the separating stations 28A, 28B and the collecting stations 38A, 38B are provided with additional gripper-like holders 52 which are mounted in such a way as to be movable up and down similarly to the support means 32 in the separating station and which are of such a design configuration that they can carry some articles. The gripper-like holder 52 of the respective separating station 28A, 28B takes over the last CDs of a stack, that is to say the lowermost CDs in the stack, by the two parts of the gripper-like holder being closed so that they engage under the lowermost CD. Thereafter, the magazine 27 in the separating station 28A, 28B can be moved downwardly by suitable actuation of the gripper 36 so that the post 18 of the magazine comes out of engagement with the CDs which are now carried by the holder 58. It is then possible for the emptied magazine to be transported in the manner already described above in the direction towards the collecting station and at the same time it is possible for a new filled magazine to be moved into the position in front of the barrier 34 so that it can be gripped and raised by the gripper 36 in the manner already described above. During that time the receiving means of the annular disk 10 are loaded from the remaining stack which is carried by the holder 52. The supply of CDs in the remainder of the stack must accordingly be of such a size that all CDs of that supply are transported away by the transfer element when the stack of the new magazine 27 has been moved by the support means 32 into the discharge position required for the individually separating operation. The gripper-like holder 52 is then also opened by moving the parts of the gripper away from each other so that the holder 32 is disposed outside the path of movement of the stack 25 which is lifted stepwise by the support means 32.

In the collecting station 38A the gripper-like holder is closed and moved into the starting position for the following stepwise downward movements, at the latest at the moment when the filled magazine has been lowered by suitable actuation of the gripper 37. During the procedure for changing the magazine, the printed CDs which have been moved into the collecting station 38A by the transfer arrangement 30A are firstly taken up by the holder 52 which is lowered stepwise with each CD, as the holder 52 of the separating station 28A is lifted stepwise with each CD taken from the remainder of the stack. Therefore a small stack of CDs is collected on the holder 52 of the collecting station. As soon as the next empty magazine is in the collecting station the gripper 52 is moved further downwardly and in that case the small stack is guided over the post 18 of the fresh magazine. It is possible for the printed CDs which at that time are disposed on the holder 52 to be guided by a suitable movement of the holder to the base of the magazine, in which case the printed CDs which then follow drop downwardly on to the part of the stack which is already present there. It is however also possible for the stack as it is being formed to be caused to rest on the holder 52 until just before the magazine is completely filled, and then the holder is correspondingly lowered stepwise, in which case the holder 52 is opened by virtue of the two parts of the holder moving away from each other, only just before the condition of complete filling of the magazine is reached, whereupon then the stack slides downwardly on to the base of the magazine in order thereafter to move the opened holder along the stack in the magazine upwardly into the receiving position and to close it shortly before the moment in time at which the first CD for the following magazine is picked up.

Corresponding considerations also apply in regard to the handling arrangement BB which is designed in the same manner and which is arranged approximately in mirror-image relationship with respect to the arrangement AA, but this does not apply in regard to the functions of the stations 28A and 38A on the one hand and the stations 28B and 30B on the other hand. These stations involve different functions, in an arrangement in mirror-image relationship. In both handling arrangements, the same references are used for parts and means which involve the same functions, although the references used possibly only have different letters.

In particular FIG. 1 of the drawing shows that the feed station 24A and the discharge station 46A are easily accessible and are disposed outside the actual region of the machine so that, in a situation involving manual handling of the magazines in the two stations 24A and 46A, that can be effected without danger and without any effects on the other region of the machine.

The drawing also shows that the conveyor belt 22A and 22B respectively is provided in the region between the separating station and the collecting station with a respective deflection portion which is directed away from the annular disk 10 of the actual printing machine and which comprises two substantially parallel belt portions 22A' and 22A", 22B' and 22B" respectively. Disposed in the respective apex region of those two belt portions is a respective drive wheel 54 for the respective belt 22A and 22B. That drive wheel is mounted displaceably in a direction which is approximately parallel to the direction in which the above-mentioned two belt portions 22A' and 22A", 22B' and 22B" respectively extend. By virtue of corresponding displacement of the drive wheel and fixing thereof in the resulting position, the belt 22A or 22B can be tensioned or slackened if required. Moreover guiding the respective belt in that way, which can be clearly seen in particular from FIG. 1, affords the advantage that in particular the apex region of the respective belt is accessible from the exterior without any difficulty. It also lies outside the region of movement of the respective transfer arrangement 30A and 30B respectively, so that it is possible if necessary for magazines to be put on to or removed from the respective belt in that region. A feed of empty magazines in the apex region of the belt may be desirable for example if, for any reasons, for example in the start-up phase, it is necessary to move an additional empty magazine into the collecting station as an empty magazine coming from the separating station is not yet available.

For satisfactory operation of the apparatus overall, it will be necessary to provide a plurality of magazines on each conveyor belt 22A, 22B, in such a way that for example at least one respective magazine filled with CDs to be printed upon is present in the region upstream of the separating station 28A and 28B in the conveyor direction 21 and at least one respective empty magazine is present in the region upstream of the collecting station 38A and 38B in the conveyor direction 21, so that after the emptied magazine has been transported away out of the respective station 28A, 28B or after the respective filled magazine has been transported away out of the station 38A, 38B, the respective next magazine is immediately available and this therefore ensures uninterrupted operation.

The at least one magazine which is upstream of the separating station or the collecting station respectively in the conveyor direction 21 can also be prevented by a respective particular barrier 50, similar to the barriers 34 and 40 respectively, from being entrained by the corresponding conveyor belt. The respective barrier is to be rendered inoperative when a magazine change procedure takes place in the respective station. More specifically the procedure in that case is such that for example in the separating station 28A, after emptying of the magazine therein, the barrier 34 is firstly lifted so that this magazine which is now empty is entrained by the conveyor belt 22A or 22B respectively. After the empty magazine has left the station 28A the barrier 34 could be closed again and immediately thereafter the barrier 50 opened so that the following filled magazine is moved by the conveyor belt 22A into the separating station 28A in which it is then firstly held by the barrier 34 in a position in which it can be gripped by the gripper 36. A corresponding procedure also applies in regard to the collecting stations 38A, 38B.

As already mentioned, the receiving means 12A and 12B are alternately provided with individual articles which are respectively supplied by way of the handling arrangements AA and BB. For that purpose, the two entry stations 29A and 29B are arranged at an arcuate spacing from each other, which corresponds to the spacing of an odd number of receiving means 12A and 12B. That also applies in regard to the two removal stations 33A and 33B. In the embodiment illustrated in the drawing, the spacing between two stations is in each case five times the spacing between two immediately adjacent receiving means 12A and 12B. The receiving means 12A or 12B which is respectively arriving in the entry station 29A or 29B is empty as the printed CD disposed in the respective receiving means had been previously removed in the removal station 33A or 33B respectively. FIG. 1 of the drawing shows that the removal station 33A or 33B is disposed upstream of the associated entry station 29A or 29B, by a respective transport step in the conveyor direction 16.

The articles which are put into the receiving means 12A in the entry station 29A are disposed, after two transport steps, at the printing station AI in which a first print image is applied to the article. That applied print image is dried in the downstream drying station AIII. After a further transport step the article passes into the printing station AII. The print image applied there is dried in the drying station AIV. A check on the quality of the finished print image can be carried out in a further station AV. During the subsequent movement through the treatment region B and the region of the transfer arrangement 30B the articles in the holders 12A are not subjected to any further treatment or handling.

In a corresponding manner, after the articles in the receiving means 12B have passed through the region of the transfer arrangement 30A and the treatment region A without any treatment being carried out, those articles are printed upon in the region B, dried and checked. The first printing operation is carried out in the station BI. In the transport step following the printing operation, the CD passes into the drying station BIII in which the previously applied print image is dried. The following transport step moves the CD into the printing station BII in which a second print image which can represent a supplement and addition to the first print image is applied to the CD. In the following station BIV which is again remote therefrom by one transport step, drying of the second print image is effected. Finally, the quality of the print image is checked in the monitoring station BV.

The treatment stations of the region B are arcuately displaced with respect to the treatment stations of the region A by a spacing which is an odd multiple of the spacing between two immediately adjacent receiving means 12A, 12B. That means that the holders with the articles, in the respective regions A and B in which those articles do not receive any treatment, are disposed between two successive transport steps of the annular disk 10 between the individual treatment stations, as the annular disk 10 is always advanced in each case by two receiving means in the conveyor direction 16.

As the two transfer arrangements 30A, 30B are also displaced relative to each other by an odd number of holders, that guarantees that the holders 12A of the one group pass through the transfer arrangement 38B and the holders 12B of the other group pass through the transfer arrangement 30A, without coming into contact with the vacuum holders 26 of the transfer element of the respective other group.

Although the above-described embodiment illustrated in the drawing serves for printing on CDs the use of the invention is not limited to articles of that kind. In addition for example, the articles can be of another shape, for example they can be in the form of rectangles or squares or of an irregular configuration.

It will be further appreciated that the above-described embodiment of the invention has been set forth solely by way of example and illustration and that various other modifications may be made without thereby departing from the scope of the invention.

What is claimed is:

1. Apparatus for printing on dimensionally stable individual articles, including a conveyor arrangement having a plurality of receiving means for respective articles for transportation of the articles along a first conveyor path, at least one entry station, disposed along said first conveyor path, for entry of the articles to be printed upon onto said first conveyor path, at least one printing station, and a removal station for removal of the printed articles from said first conveyor path, a separating station into which articles to be printed upon are transported in a magazine as a stack comprising a plurality of articles and are individually separated therein to be each fitted in the entry station into a receiving means of the conveyor arrangement, a collecting station in which printed articles removed in the removal station from the respective receiving means of the conveyor arrangement are collected and assembled in a magazine in the collecting station to form a stack comprising a plurality of articles, a conveyor means operable to convey the magazines containing the articles to be printed upon towards the entry station and to convey empty magazines thereafter towards the removal station, including a conveyor belt for conveying the magazines both through the separating station and also through the collecting station and operable to convey the empty magazines out of the separating station into the collecting station, at least one transfer arrangement operable for individually removing the articles to be printed upon from the respective magazine and for moving them towards the respective receiving means of the conveyor arrangement and for feeding the articles removed from the respective receiving means of the conveyor arrangement to a magazine, including at least one transfer means operable to move with a stepwise motion for the individual articles and providing a second conveyor path along which a magazine disposed in the separating station, the receiving means respectively disposed in the entry station for the article to be printed upon, the respective receiving means disposed in the removal station for the printed article, and a magazine disposed in the collecting station are disposed.

2. Apparatus as set forth in claim 1 wherein the conveyor belt is operable to convey a magazine with the articles to be printed upon into the separating station.

3. Apparatus as set forth in claim 1 wherein the conveyor belt is operable to convey a magazine with the printed articles out of the collecting station.

4. Apparatus as set forth in claim 1 and including upstream of a magazine in the separating station in the conveyor direction of the conveyor belt a buffer space for at least one further magazine filled with articles to be printed upon.

5. Apparatus as set forth in claim 1 and including upstream of a magazine in the collecting station in the conveyor direction of the conveyor belt a buffer space for at least one empty magazine.

6. Apparatus as set forth in claim 1 wherein the conveyor belt is in the form of a curved conveyor belt.

7. Apparatus as set forth in claim 1 including a feed station for feeding articles to the conveyor belt and a discharge station for discharge of articles from the conveyor belt, the feed and discharge stations being arranged in side-by-side relationship.

8. Apparatus as set forth in claim 1 including a respective gripper in the separating station and in the collecting station and operable for gripping and aligning a magazine respectively disposed in the separating station and the collecting station and raising the gripped magazine to a height which is respectively suitable for removal of the articles to be printed upon from the magazine and for entry of the printed articles into the magazine.

9. Apparatus as set forth in claim 1 including a respective holder for a supply of articles in the separating station and in the collecting station, and means for moving the holder upwardly and downwardly, the [size of the] supply being of a size such that, during a magazine change procedure in the separating station and in the collecting station, the supply of articles permits continuous operation of the apparatus.

10. Apparatus for printing on dimensionally stable individual articles, including a conveyor arrangement having a plurality of receiving means for respective articles for transportation of the articles along a first conveyor path, at least one entry station, disposed along said first conveyor path, for entry of the articles to be printed upon onto said first conveyor path, at least one printing station, and a removal station for removal of the printed articles from said first conveyor path, a separating station into which articles to be printed upon are transported in a magazine as a stack comprising a plurality of articles and are individually separated therein to be each fitted in the entry station into a receiving means of the conveyor arrangement, a collecting station in which printed articles removed in the removal station from the respective receiving means of the conveyor arrangement are collected and assembled in a magazine in the collecting station to form a stack comprising a plurality of articles, a conveyor means operable to convey the magazines containing the articles to be printed upon towards the entry station and to convey empty magazines thereafter towards the removal station, including a conveyor belt for conveying the magazines both through the separating station and also through the collecting station and operable to convey the empty magazines out of the separating station into the collecting station, and at least one transfer arrangement operable for individually removing the articles to be printed upon from the respective magazine and for moving them towards the respective receiving means of the conveyor arrangement and for feeding the articles removed from the respective receiving means of the conveyor arrangement to a magazine, including at least one transfer means operable to move with a stepwise motion for the individual articles and providing a second conveyor path for a magazine respectively disposed in the separating station, the receiving means respectively disposed in the entry station for the article to be printed upon, the respective receiving means disposed in the removal station for the printed article, and the magazine disposed in the collecting station, said apparatus also including at least a first printing station, at least a second printing station, a conveyor arrangement operable with a stepwise motion for conveying articles through at least the first printing station and through at least the second printing station, wherein the conveyor arrangement is provided with at least two said receiving means, the arrangement being such that a first group of articles conveyed by the conveyor arrangement is printed upon in at least a first printing station and a second group of articles is printed upon in at least a second printing station, and further including for each respective group of articles at least one respective entry station for the articles to be printed upon, at least one respective removal station for the printed articles, a respective said conveyor belt and a respective said transfer arrangement.

11. Apparatus as set forth in claim 10 wherein the conveyor arrangement is in the form of a table having a periphery in the proximity of which the table comprises the receiving means for the articles, and including means for rotating the table about a vertical axis.

12. Apparatus as set forth in claim 11 wherein the table is of an annular shape.

13. Apparatus for printing on dimensionally stable individual articles, including a conveyor arrangement having a plurality of receiving means for respective articles for transportation of the articles along a first conveyor path, at least one entry station, disposed along said first conveyor path, for entry of the articles to be printed upon onto said first conveyor path, at least one printing station, and a removal station for removal of the printed articles from said first conveyor path, a separating station into which articles to be printed upon are transported in a magazine as a stack comprising a plurality of articles and are individually separated therein to be each fitted in the entry station into a receiving means of the conveyor arrangement, a collecting station in which printed articles removed in the removal station from the respective receiving means of the conveyor arrangement are collected and assembled in a magazine in the collecting station to form a stack comprising a plurality of articles, a conveyor means operable to convey the magazines containing the articles to be printed upon towards the entry station and to convey empty magazines thereafter towards the removal station, including a conveyor belt for conveying the magazines both through the separating station and also through the collecting station and operable to convey the empty magazines out of the separating station into the collecting station, at least one transfer arrangement operable for individually removing the articles to be printed upon from the respective magazine and for moving them towards the respective receiving means of the conveyor arrangement and for feeding the articles removed from the respective receiving means of the conveyor arrangement to a magazine, including at least one transfer means operable to move with a stepwise motion for the individual articles and providing a second conveyor path for a magazine respectively disposed in the separating station, the receiving means respectively disposed in the entry station for the article to be printed upon, the respective receiving means disposed in the removal station for the printed article, and the magazine disposed in the collecting station, and a respective gripper in the separating station and in the collecting station and operable for gripping and aligning a magazine respectively disposed in the separating station and the collecting station and raising the gripped magazine to a height which is respectively suitable for removal of the articles to be printed upon from the magazine and for entry of the printed articles into the magazine, wherein each gripper comprises gripping parts suitable for gripping and releasing a respective article and the conveyor belt is passed through between the parts of the respective gripper.

14. Apparatus for printing on dimensionally stable individual articles, including a conveyor arrangement having a plurality of receiving means for respective articles for transportation of the articles along a first conveyor path, at least one entry station, disposed along said first conveyor path, for entry of the articles to be printed upon onto said first conveyor path, at least one printing station, and a removal station for removal of the printed articles from said first conveyor path, a separating station into which articles to be printed upon are transported in a magazine as a stack comprising a plurality of articles and are individually separated therein to be each fitted in the entry station into a receiving means of the conveyor arrangement, a collecting station in which printed articles removed in the removal station from the respective receiving means of the conveyor arrangement are collected and assembled in a magazine in the collecting station to form a stack comprising a plurality of articles, a conveyor means operable to convey the magazines containing the articles to be printed upon towards the entry station and to convey empty magazines thereafter towards the removal station, including a conveyor belt for conveying the magazines both through the separating station and also through the collecting station and operable to convey the empty magazines out of the separating station into the collecting station, and at least one transfer arrangement operable for individually removing the articles to be printed upon from the respective magazine and for moving them towards the respective receiving means of the conveyor arrangement and for feeding the articles removed from the respective receiving means of the conveyor arrangement to a magazine, including at least one transfer means operable to move with a stepwise motion for the individual articles and providing a second conveyor path for a magazine respectively disposed in the separating station, the receiving means respectively disposed in the entry station for the article to be printed upon, the respective receiving means disposed in the removal station for the printed article, and the magazine disposed in the collecting station, wherein the conveyor belt has first and second portions which extend in at least substantially parallel relationship and define an apex region, and including at the apex region a drive wheel operable to engage the conveyor belt, and means mounting the drive wheel displaceably and lockably in its respective position.

15. Apparatus as set forth in claim 14 wherein the apex region of the at least substantially parallel portions of the conveyor belt is accessible from the exterior.

* * * * *